US007670642B2

(12) United States Patent
Pickering et al.

(10) Patent No.: US 7,670,642 B2
(45) Date of Patent: Mar. 2, 2010

(54) METHOD OF POWDER COATING FOR OFFSET PREVENTION IN ELECTROPHOTOGRAPHIC PRINTERS

(75) Inventors: Jerry A. Pickering, Hilton, NY (US); Xin Jin, Pittsford, NY (US); Dinesh Tyagi, Fairport, NY (US); Kurt E. Jones, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 981 days.

(21) Appl. No.: 11/376,960

(22) Filed: Mar. 16, 2006

(65) Prior Publication Data

US 2007/0218195 A1 Sep. 20, 2007

(51) Int. Cl.
*B05D 1/12* (2006.01)

(52) U.S. Cl. ..... 427/201; 427/202

(58) Field of Classification Search ..... 427/201
See application file for complete search history.

(56) References Cited

U.S. PATENT DOCUMENTS 3,911,160 A * 10/1975 Neuberg ..... 427/469
5,699,743 A * 12/1997 Ganz et al. ..... 101/488
6,103,794 A * 8/2000 Laver ..... 524/84
6,119,598 A * 9/2000 Reynolds et al. ..... 101/488

* cited by examiner

*Primary Examiner*—Frederick J Parker
(74) *Attorney, Agent, or Firm*—Carl F. Ruoff; Andrew J. Anderson

(57) ABSTRACT

The present invention provides a method of printing which includes providing a substrate having an inked surface. The inked surface is typically achieved using an offset lithographic printing press. A thermoplastic polymer powder is applied to the inked surface. The surface is then fused. An advantage of the prepared substrate is that there is reduced contamination of electrostatographic fusing systems when fused by heat and pressure fixing. Another aspect of the invention further provides a method of fusing a substrate having an inked surface wherein a thermoplastic powder has been applied to the inked surface prior to stacking the uncured offset prints.

20 Claims, 2 Drawing Sheets

METHOD OF POWDER COATING FOR OFFSET PREVENTION IN ELECTROPHOTOGRAPHIC PRINTERS

FIELD OF THE INVENTION

The present invention is related to the fusing of substrates after the substrates have had liquid ink applied to a surface, typically through an offset printing machine

BACKGROUND OF THE INVENTION

Offset lithographic printing is a cost effective method for generating many thousands of identical full color images. The process provides a blanket, where the surface of the blanket has an image. The process further provides an inking solution in contact with the blanket and the image on the blanket wherein the ink of the inking solution is transferred to the image on the blanket creating an inked image. The inked image on the blanket is then placed in contact with the desired receiver, either directly or after transfer to another surface, where the inked image then substantially transfers to the receiver. This process may be repeated for each of the desired inks in a particular image, limited by the number of stations in the printing process. The finished print is then stacked at the end of the process and allowed to dry and cure.

In typical lithographic printing processes the process generates finished sheets rapidly such that the sheets are stacked while the ink is still wet. This causes a problem of the inked surface of one sheet contacting and adhering or "offsetting" to the backside of the next sheet in the stack. To prevent this problem of offsetting it is common to dust the surface of each sheet exiting the printing process with a particulate that acts to provide a small gap of separation between the sheets. This anti-offsetting powder is typically starch. Coated and surface treated starches are also used in the industry.

Because each image in a typical lithographic print run is exactly the same, prints may then be passed through a digital printing device in order to add unique information to each sheet such as an address, a personalized coupon, or other information or image. The sheet is typically printed first by the lithographic printing process to create a shell with designated locations for the added digital information. Prior to adding the unique information, the print may be referred to as a pre-printed shell or pre-printed media. The pre-printed shell may be stored until the additional information is added, or it may be transferred to the digital printing device as soon as it is dry and cured.

One such digital printing device is an electrostatographic printer using a thermoplastic toner powder and heat and pressure fixing or fusing to generate the unique information. When the pre-printed media is passed through this printer, the anti-offsetting starch powder causes problems by contamination of the systems of the electrostatographic process, particularly in the fuser where the heat and pressure fixing of the toner powder is accomplished.

The fuser of an electrostatographic printer using a thermoplastic toner powder typically comprises a fuser member surface, typically a fuser roller or belt, in contact with the media surface providing heat to melt the thermoplastic toner. The fuser further provides an opposing pressure member surface, typically a pressure roller or belt, pressing against the back of the media providing pressure to adhere the toner melt to the media. To prevent the toner melt from contaminating the fuser member surface, an oiler may apply release oil. Further, to clean any contamination that does occur, the fuser member may provide a cleaning member. A fuser member provides heat either by means of an internal heating lamp, or by external heating such as contact with heated rollers. In a particular method of heating the fuser roller using external heating rollers, the external heating rollers are further used to collect toner contamination for cleaning by a cleaning web in contact with the aforementioned heating rollers.

Contamination by preprinted media takes the appearance of colored stripes on the oiling member and cleaning member. For preprinted media that has been appropriately dried and cured, analysis of contamination material shows that the contamination contains only trace amounts of ink or toner and is primarily composed of starch-like material and release oil. In fact, the majority of the signal that is not release oil is identical to the starch anti-offsetting powder. It is thought that the powder, having been added to the surface while the ink is still wet, has a portion of ink attached providing the colored appearance. It is also thought that the powder acts to transfer the ink to other surfaces providing intimate contact for further contamination and degradation of the surfaces. The ease with which the powder contaminates fuser parts is due to the non-thermoplastic nature of the starch anti-offsetting powder. Since the powder does not soften, it does not melt and easily transfers to the fuser. In addition, where the fuser is heated by contact with external heater rollers, the starch does not efficiently transfer to the heating rollers and the associated cleaning system. This behavior is also thought to be due to the lack of softening or melting of the toner when in contact with the high temperature heater rollers. This behavior further leads to increased contamination of the oiler member. It would be useful to provide an anti-offsetting powder that does not contribute to fuser contamination.

SUMMARY OF THE INVENTION

The present invention provides a method of printing which includes providing a substrate having an inked surface. The inked surface is typically achieved using an offset lithographic printing press. A thermoplastic polymer powder is applied to the inked surface. An advantage of the prepared substrate is that there is reduced contamination of electrostatographic fusing systems when fused by heat and pressure fixing. Another aspect of the invention further provides a method of fusing a substrate having an inked surface wherein a thermoplastic powder has been applied to the inked surface prior to stacking the uncured offset prints.

BRIEF DESCRIPTION OF THE DRAWINGS

The above-mentioned and other features of this invention and the manner of attaining them will become more apparent and the invention itself will be better understood by reference to the following description of an embodiment of the invention taken in conjunction with the accompanying figures wherein:

FIG. 1(*b*) shows the offset particle powder post fusing.

FIG. 2(*b*) shows the offset particle powder post fusing.

DETAILED DESCRIPTION OF THE INVENTION

Figure 1A:
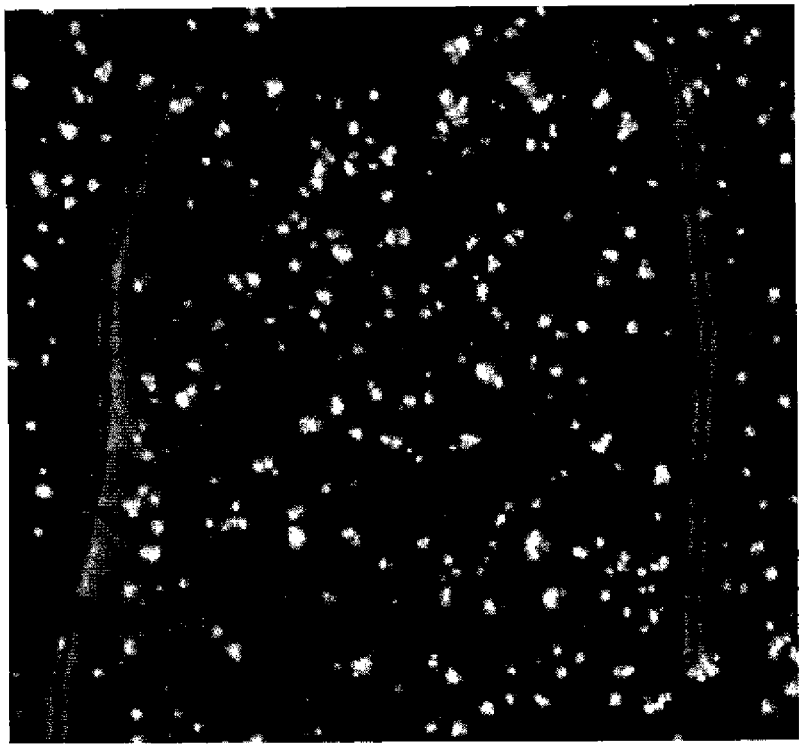
FIG. 1(*a*) shows the offset particle powder of the present invention applied to an inked sheet prior to fusing.

The invention provides an offsetting prevention powder that is a thermoplastic material. The powder provides the prevention of backside marking of wet inked sheets (offsetting), yet in an electostatographic printing device the powder will soften and fuse similar to conventional toner. By acting like a toner powder, the offsetting powder is fused as effectively as image toner, and is cleaned by the system similarly to image toner. In addition, other subsystems can more easily accommodate contamination of the offsetting powder since the powder is more similar in behavior to the imaging toner powder materials.

The anti-offsetting powder of the invention comprises a thermoplastic polymer. A thermoplastic polymer softens or melts at elevated temperature. The thermoplastic powder preferably has a glass transition or a melt point of at least about 40° C. The glass transition or melt point is preferably between about 40° C. and 120° C., more preferably between about 45° C. and 100° C., and is most preferably between about 50° C. and 80° C.

When softened or melted in a fuser, the polymer viscosity provides sufficient tack to adhere to the substrate without cohesive failure. The polymer viscosity at 120° C. is preferably between about 5,000 and about 500,000 poise. Viscosities below about 5000 poise do not have sufficient melt strength to prevent cohesive failure of the polymer melt, which would cause the melt to split and transfer polymer material to the fuser surface. Polymer material that is transferred to the fuser surface is contamination and degrades the performance of the fuser. Polymer melt viscosities greater than about 500,000 poise do not flow sufficiently to adhere to the receiver surface and will not provide the advantage of the invention. Without sufficient melt flow the particles will behave similarly to the conventional starch powders.

The polymer of the thermoplastic powder may be linear, branched, partially crosslinked, or a combination of these. When the polymer is partially crosslinked, the amount of crosslinking is determined by the percentage gel component. The thermoplastic powder is preferred to comprise at least one or more of a gel component. The gel component comprises 0-40 percent by volume of the polymer, preferably 5-40 percent by volume of the polymer, more preferably 5-20 percent by volume of the polymer. The gel component provides enhanced cohesive strength to the polymer melt. Enhanced cohesive strength of the polymer melt improves resistance to cohesive fracture of the polymer melt in the fuser and thus reduces undesirable contamination of the fuser surface. An excessive amount of gel in the polymer prevents sufficient melt flow to provide the advantage of the invention.

The polymer preferably has a desired brittleness to aid it achieving a suitable particle size. A polymer that is extremely brittle will tend to generate smaller particle if a grinding method is employed. Conversely, less brittle particles will tend to generate larger particles in a grinding process. Processes to achieve the desired particles size that avoid grinding do not require a specific brittleness.

The polymer powder of the invention may be any thermoplastic polymer having an appropriate glass transition or melt point and manufacturable to the desired viscosity and particle size. The polymer must also be reasonably stable to elevated temperature and not evolve toxic compounds at temperatures typical of an electrostatographic fusing subsystem. Electrostatographic fusing subsystems typically operate with surface temperatures of between about 100 and 180° C. Preferred thermoplastic polymers include polymeric binders used for electrostatographic toners, for example a styrene-butylacrlyate polymer, a styrene-butadiene polymers and a polyester polymer.

The thermoplastic polymer powder may be made using a limited coalescence reaction such as the suspension polymerization procedure disclosed in U.S. Pat. No. 4,912,009 to Amering et al., which is incorporated in its entirety by reference herein.

In another typical manufacturing process commonly used for polymeric binders for electrostatographic toners, the polymers are made by polymerization of selected monomers followed by mixing with various additives and then grinding to a desired size range. During manufacturing, the polymeric binder is subjected to melt processing in which the polymer is exposed to moderate to high shearing forces and temperatures in excess of the glass transition temperature of the polymer. The temperature of the polymer melt results, in part, from the frictional forces of the melt processing. The melt processing includes melt-blending of addenda into the bulk of the polymer.

The thermoplastic polymer composition of this invention can be made by melt processing the polymer binder in for example a two-roll mill or extruder. This procedure can include melt blending of other materials with the polymer. A performed mechanical blend of the binder polymer and other toner additives can be prepared, and then roll milled or extruded. The roll milling, extrusion, or other melt processing is performed at a temperature sufficient to achieve a uniformly blended composition. The resulting material, referred to as a "melt product" or "melt slab" is then cooled. For a polymer having a Tg in the range of about 50° C. to about 120° C., or a $T_m$ in the range of about 65° C. to about 200° C., a melt blending temperature in the range of about 90° C. to about 240° C. is suitable using a roll mill or extruder. Melt blending times, that is, the exposure period for melt blending at elevated temperature, are in the range of about 1 to about 60 minutes.

The melt product is cooled and then pulverized to a volume average particle size of from about 6 microns to about 60 microns, preferably between about 8 microns to about 40 microns, most preferably from about 12 microns to about 30 microns. It is generally preferred to first grind the melt product prior to a specific pulverizing operation. The grinding can be carried out by any convenient procedure. For example, the solid composition can be crushed and then ground using, for example, a fluid energy or jet mill, such as described in U.S. Pat. No. 4,089,472, and can then be classified in one or more steps. In the case of direct suspension polymerization the cost of drying and grinding is minimized.

The toner composition of this invention can alternatively be made by dissolving the polymer in a solvent in which the charge control agent and other additives are also dissolved or are dispersed. The resulting solution can then be spray dried to produce particulate toner powders. Methods of this type include limited coalescence polymer suspension procedures as disclosed in U.S. Pat. No. 4,833,060 which are particularly useful for producing small, uniform toner particles.

The term "particle size," "size," or "sized" as used herein in reference to the term "particles", means the median volume weighted diameter as measured by conventional diameter measuring devices, such as a Coulter Multisizer, sold by Coulter, Inc. of Hialeah, Fla. The median volume weighted diameter is the diameter of an equivalent weight spherical particle that represents the median for a sample.

Useful thermoplastic polymers include vinyl polymers, such as homopolymers and copolymers of styrene. Styrene polymers include those containing 40 to 100 percent by weight of styrene, or styrene homologs, and from 0 to 40 percent by weight of one or more lower alkyl acrylates or methacrylates. Other examples include fusible styrene-acrylic copolymers that are covalently lightly crosslinked with a divinyl compound such as divinylbenzene. Binders of this type are described, for example, in U.S. Reissue Pat. No. 31,072, which is incorporated in its entirety by reference wherein. Preferred binders comprise styrene and an alkyl acrylate and/or methacrylate and the styrene content of the binder is preferably at least about 60% by weight.

Copolymers rich in styrene such as styrene butylacrylate and styrene butadiene are also useful as binders as are blends of polymers. In such blends, the ratio of styrene butylacrylate to styrene butadiene can be 10:1 to 1:10. Ratios of 5:1 to 1:5 and 7:3 are particularly useful. Polymers of styrene butylacrylate and/or butylmethacrylate (30 to 80% styrene) and styrene butadiene (30 to 80% styrene) are also useful binders.

Styrene polymers include styrene, alpha-methylstyrene, para-chlorostyrene, and vinyl toluene; and alkyl acrylates or methylacrylates or monocarboxylic acids having a double bond selected from acrylic acid, methyl acrylate, 2-ethylhexyl acrylate, 2-ethylhexyl methacrylate, ethyl acrylate, butyl acrylate, dodecyl acrylate, octyl acrylate, phenylacrylate, methylacrylic acid, ethyl methacrylate, butyl methacrylate and octyl methacrylate and are also useful binders.

Also useful are condensation polymers such as polyesters and copolyesters of aromatic dicarboxylic acids with one or more aliphatic diols, such as polyesters of isophthalic or terephthalic acid with diols such as ethylene glycol, cyclohexane dimethanol, and bisphenols. Other useful resins include polyester resins, such as by the co-polycondensation polymerization of a carboxylic acid component comprising a carboxylic acid having two or more valencies, an acid anhydride thereof or a lower alkyl ester thereof (e.g., fumaric acid, maleic acid, maleic anhydride, phthalic acid, terephthalic acid, trimellitic acid, or pyromellitic acid), using as a diol component a bisphenol derivative or a substituted compound thereof. Specific examples are described in U.S. Pat. Nos. 5,120,631; 4,430,408; and 5,714,295, all incorporated herein by reference, and include propoxylated bisphenol—A fumarate, such as Fineton™ 382 ES from Reichold Chemicals, formerly Atlac™ 382 ES from ICI Americas Inc.

A useful binder can also be formed from a copolymer of a vinyl aromatic monomer; a second monomer selected from either conjugated diene monomers or acylate monomers such as alkyl acrylate and alkyl methacrylate. Useful binder for the polymeric powders can also be a multi-component mixture of above polymer binders.

The powder is preferably clear, and may contain additional addenda comprising charge agent, flow agents, wax, and fillers.

Thermoplastic particles employed in the process of the present invention further optionally include a release agent such as, for example, an aliphatic fatty acid containing about 10 to about 26 carbon atoms, or a metal salt, ester, or amide of the fatty acid. Other useful release agents include waxes and low molecular weight polyolefins such as, for example, polyethylene and polypropylene. The release agent is included in the toner particles in an amount of about 1 part to about 25 parts per 100 parts binder polymer.

Another preferred but optional component is a charge control agent. The term "charge control" refers to a propensity of powder addenda to modify the triboelectric charging properties of the resulting powder. A very wide variety of charge control agents for positive charging powders are available. A large, but lesser number of charge control agents for negative charging powders are also available. Suitable charge control agents are disclosed, for example, in U.S. Pat. Nos. 3,893,935; 4,079,014; 4,323,634; 4,394,430 and British Patents 1,501,065; and 1,420,839. Charge control agents are generally employed in small quantities such as, from about 0.1 to about 5 weight percent based upon the weight of the powder. Additional charge control agents which are useful are described in U.S. Pat. Nos. 4,624,907; 4,814,250; 4,840,864; 4,834,920-4,683,188, 4,780,553 and 4,624,907.

Flow agents are used to modify the flow properties of the powder. Powder flow properties are important for proper delivery of the powder in dispensing equipment commonly known in the art. Flow agents are typically submicon powders added to enhance powder flow. Typical flow agents include silica, titania and the like. A hydrophobic silica, designated R972, and manufactured by Nippon Aerosil may be used. The amount of silica used for surface treatment would range from 0.1 to 3% by weight of the powder, depending on the product requirements and the powder particle size. For surface treatment, thermoplastic powder and silica are typically mixed in a 10 liter Henschel mixer with a 4 element impeller for 2 to 30 minutes at 2000 RPM. The silica surface treated powder may be sieved through an appropriate mesh vibratory sieve to remove un-dispersed silica agglomerates and any powder flakes that may have formed during the surface treatment process. The temperature during the surface treatment can be controlled to some desired level during the blending operation.

Fillers may be used to reduce the cost of the powder, however these are generally minimized to maintain clarity.

In another embodiment of the invention, the powder is tailored to an electrostatographic process. Charge agents control the tribocharging of the powder, and may be selected to behave favorably in a specific electrostatographic process. In this regard, the charge behavior of the powder can be modified to mimic the behavior of the toner of the selected electrostatographic process. During development, charged toner particles are delivered to the photoconductor (PC) surface in an image-wise fashion. The attraction of the toner is dependent on the surface voltage of the PC, and the toner particles may be attracted to either the discharged regions of the PC or the charged regions of the PC. Transfer of toner from the PC is done by creating an electric field between the receiver and the PC. This can be done using a corona charger or by placing a biased roller behind the receiver. The powders preferably develop the same sign as the toner so that it will be transferred to or remain with the receiver. When the powder is so modified, problems associated with contamination of the processes by the powdered sheets are minimized.

Sufficient tribocharging of the thermoplastic powder against a carrier is determined by the charge to mass developed on the powder and the powder particle size. The powder has sufficient tribocharging against a carrier when the charge to mass in micro Coulombs per gram multiplied by the average diameter in microns is greater than about 200, or more preferably greater than about 250.

In the event that the powder is transferred to the toning station, the powder can accumulate in the station unless the toning process actively removes it. In this regard, the powders preferably will tribocharge while in the toning station. Powders in the toning station are tribocharged by carrier particles that reside in the toning station, and once charged, the powder will be removed from the process. Powders that do not significantly tribocharge against the carrier particles may accumulate in the station, harming the toning process, or may 'dust' into the electrostatographic process and contaminate corona wires and writer heads. Particles 'dust' when they are thrown into the air by the action of the toning station but do not have sufficient charge on the particle to cause them to be attracted to the photoconductor. Powder tribocharging may be evaluated by agitating the powder with carrier particles of the selected electrophotographic process and measuring the charge that develops on the powder.

The invention also provides a method of generating shells for subsequent variable printing using electrostatographic methods wherein the shells are dusted with an offsetting preventing powder to prevent backside ink contamination wherein the offsetting prevention powder is a thermoplastic comprising a viscosity at 120° C. of between about 5,000 and about 500,000 poise.

The invention further provides a method for fusing pre-printed shells that have been dusted with said thermoplastic offset preventing powder.

EXAMPLES OF THE INVENTION

Example 1

Preparation of a Ground Anti-Offsetting Powder

A styrene-butylacrylate (SB) polymer was ground to form a powder. A portion of this ground SB powder was tested for powder flow for comparison to several commercial anti-offsetting spray powders. An amount of 2 grams in a 2.6 mm funnel was used at an RH of 29%. The SB powder has the highest powder flow time, about 50% higher than Spray powder 2V (Table 1).

TABLE 1

| Sample | Average Vibratory Funnel Flow Time (sec) |
|---|---|
| Spray Powder 2V | 19.57 |
| Spray Powder 2U | 11.95 |
| OxyDry Food Starch Powder Type 5929 | 6.27 |
| OxyDry Food Starch Powder Type C | 13.35 |
| Example 1 | 30.5 |

Table 1 demonstrates that reasonable flow properties are obtained using the polymer powder without added addenda. It is predicted that faster flow times would be obtained with the addition of a small amount of silicon dioxide as a flow agent. Acceptable flow times are required for successful powder delivery in anti-offsetting powder delivery systems.

Application to PPM Sheets

Oxy Dry 5929 and the SB polymer were added to separate plastic cups and a section of Nomex web secured over the top. The porous Nomex web material provides a fine screen from which the powders may be dusted onto freshly inked sheets. An amount of 3 cc of Sun Chemical NatGlo 15% voc cyan ink was measured out onto the platen of a Little Joe model "H" proofing press (from Little Joe Industries of Hillsborough, N.J.) proofing press and uniformly distributed on the platen. The press plate was inked with 5 back and forth passes of the brayer roller, and the blanket was similarly inked with 5 passes or the blanket over the metal platen. A sheet of Domtar Luna Gloss was placed on the transfer plate and inked in a single pass. The first sheet (sheet 0) was discarded. The process of inking the press plate and blanket was repeated and a new sheet of Luna Gloss inked (sheet 1). The inked sheet was immediately removed and placed in an open cardboard box (to eliminate drafts) and dusted with the SB powder. The process was repeated again to generate sheet 2 except that the resulting inked sheet was dusted with Oxy Dry 5929 powder. The process was again repeated until 8 sheets were prepared, alternating between the two anti-offsetting powders. In summary, sheets 1, 3, 5, and 7 were dusted with the SB powder; and sheets 2, 4, 6, and 8 were dusted with the Oxy Dry powder.

The sheets were allowed to cure at ambient conditions for three days. Specific locations on the sheets were marked to define a small area of the sheet surface. Sheets were then imaged using an optical microscope with an image capture device. The marked locations were imaged for comparison after passing through an electrophotographic printing system. The locations were marked either by scoring the surface with the end of a set of fine needle tweezers, or by removing the dusted particulate around a perimeter with a blunt wooden applicator.

Figure 2A:
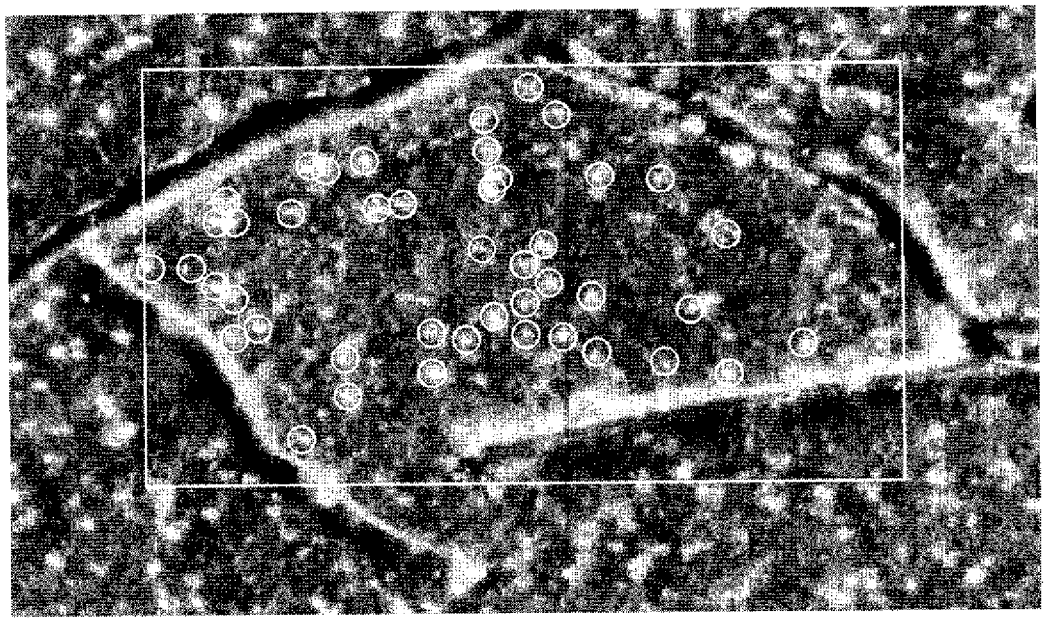
FIG. 2(*a*) shows offset particle powder of the prior art applied to an inked sheet prior to fusing.
Figure 2B:
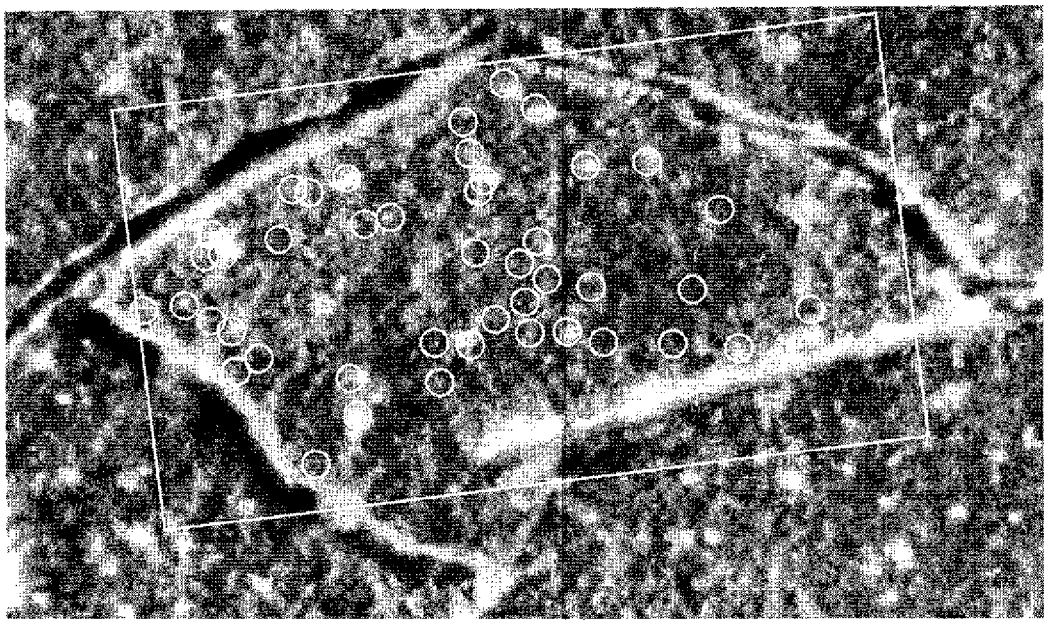

It is observed that prior to passing through the electrophotographic printing system, the Oxy Dry powder is easily blown from the surface of the paper where there is no ink, but is well tacked down in the inked area. However, a light finger touch easily removes the powder from either area. This is shown in FIG. 2 (*a*).

Figure 1B:
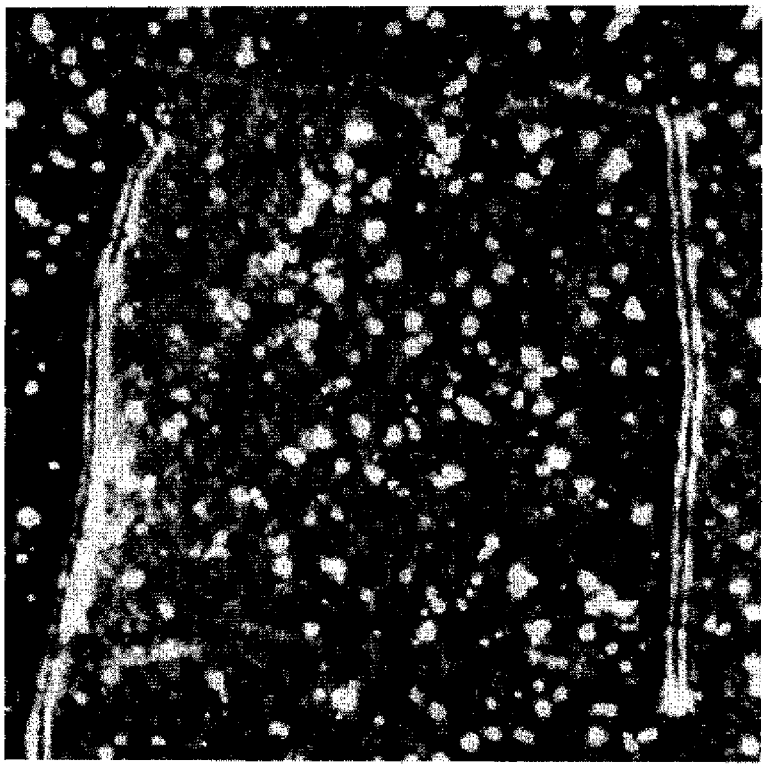

It is also observed that prior to passing through the electrophotographic printing system, the SB toner powder appears relatively well adhered in both the inked and non-inked areas, in as far as it is not easily blown from either. This is shown in FIG. 1(*a*). However, similar to the Oxy Dry powder the SB powder is easily removed by a light finger touch from both inked and non-inked areas.

Fusing of Test Sheets.

Four sheets, two with Oxy Dry and two with the SB powder were placed in the paper stack of a Digimaster 9150 Digital printer with a ream of approximately 500 sheets of Hammermill 201b bond test paper. The fuser temperature, process speed, and oil rate were all at nominal settings for the 9150. In the process a fuser roller contacts and fuses the dusted inked sheets.

The order of the sheets passing through the electrophotographic process and fusing system was as follows: approximately 500 Hammermill sheets were run, then the sheet dusted with SB Powder, then the sheet dusted with Oxy Dry Powder, then 20 Hammermill test paper sheets, then the sheet dusted with Oxy Dry Powder, and lastly the sheet dusted with SB Powder.

After fusing the sheets were collected and imaged again in the marked locations. These images are shown in FIGS. 1(*b*) and 2 (*b*).

It is observed that after passing through the electrophotographic printing system, the behavior of the Oxy Dry powder appears unchanged. (FIG. 2(*b*)) It is still easily removed with a light finger touch from either inked or un-inked areas. However, the SB powder is well adhered to the surface in both the inked and un-inked areas. (FIG. 1(*b*))

TABLE 2

| Anti-Offsetting Powder | Print # | Number of Particles in Marked Perimeter Before Fusing | Number of Particles in Marked Perimeter After Fusing | Percentage of Particles Remaining |
|---|---|---|---|---|
| QxyDry 5929 | Print 6 | 44 | 14 | 32 |
| QxyDry 5929 | Print 8 | | | 37 |
| Example 1 | Print 5 | 134 | 127 | 95 |
| Example 1 | Print 7 | | | 74 |

The results from Table 2 clearly show the advantage of the thermoplastic anti-offsetting powder particles of the invention. Using the particles of the invention, fewer particles are removed from the sheet and transferred to the fuser or electrophotographic system. Fewer particles removed means less contamination of the printer. For particles that are removed, the particles are more closely related to the thermoplastic toner used in the printer and are, therefore, more easily managed by the printer. The observation that the SB powder becomes resistant to removal while the Oxydry powder does not is consistent with the sintering of the thermoplastic powder to the surface and thus it becomes less likely to transfer to the fuser roller in the printer and contaminate the printer.

The invention has been described in detail with particular reference to certain preferred embodiments thereof, but it will be understood that variations and modifications can be effected within the spirit and scope of the invention.

The invention claimed is:

1. A method of printing comprising:

providing a substrate having an inked surface;

applying to the inked surface a thermoplastic polymer powder;

wherein the thermoplastic polymer powder is selected form the group consisting of styrene-alkylacrlyate polymer, styrene-butadiene polymer and polyester polymer.

2. The method of claim 1 wherein the thermoplastic polymer powder has a viscosity of from 500 to 500,000 poise at 120° C.

3. The method of claim 1 further comprising:

fusing the thermoplastic powder.

4. The method of claim 1 wherein the thermoplastic polymer powder further comprises charge control agents.

5. The method of claim 1 wherein the thermoplastic polymer powder further comprises flow control agents.

6. The method of claim 1 wherein the thermoplastic polymer powder further comprises wax.

7. The method of claim 1 wherein the thermoplastic polymer powder further comprises a gel component.

8. The method of claim 7 wherein the gel component is in the amount of 5-40 percent by volume of the polymer.

9. The method of claim 1 wherein the polymer powder tribocharges when in contact with an electorphotographic carrier.

10. The method of claim 1 wherein the polymer powder has a melting point between 40 and 120° C.

11. The method of claim 1 wherein the polymer powder comprises a charge to mass ratio greater than 200 Coulombs per gram.

12. The method of claim 1 wherein the polymer powder has a glass transition or melt point between 45 and 100° C.

13. The method of claim 1, further comprising passing the substrate having an inked surface and applied thermoplastic polymer powder through an electrophotographic printing system, wherein the electrophotographic printing system employs charged toner particles tribocharged by carrier particles in a toning station, and the thermoplastic polymer powder comprises a charge control agent such that powder transferred to the toning station are tribocharged to develop the same sign of charge as the toner.

14. A method of printing comprising:

providing a substrate having an inked surface;

applying to the inked surface a thermoplastic polymer powder; and passing the substrate having an inked surface and applied thermoplastic polymer powder through an electrophotographic printing system;

wherein the electrophotographic printing system employs charged toner particles tribocharged by carrier particles in a toning station, and the thermoplastic polymer powder comprises a charge control agent such that powder transferred to the toning station are tribocharged to develop the same sign of charge as the toner.

15. The method of claim 14 wherein the thermoplastic polymer powder has a viscosity of from 500 to 500,000 poise at 120° C.

16. The method of claim 14 further comprising:

Rising the thermoplastic powder.

17. The method of claim 15 wherein the thermoplastic polymer powder further comprises flow control agents.

18. The method of claim 14 wherein the thermoplastic polymer powder further comprises wax.

19. The method of claim 14 wherein the polymer powder comprises a charge to mass ratio greater than 200 Coulombs per gram.

20. The method of claim 14 wherein the polymer powder has a glass transition or melt point between 45 and 100° C.

* * * * *

UNITED STATES PATENT AND TRADEMARK OFFICE

CERTIFICATE OF CORRECTION

PATENT NO. : 7,670,642 B2
APPLICATION NO. : 11/376960
DATED : March 2, 2010
INVENTOR(S) : Pickering et al.

It is certified that error appears in the above-identified patent and that said Letters Patent is hereby corrected as shown below:

In Column 9, line 18 (Claim 1), delete "styrene-alkylacrlyate" and insert -- styrene-alkylacrylate --.

In Column 9, line 36 (Claim 9), delete "electorphotographic" and insert -- electrophotographic --.

In Column 10, line 30 (Claim 16), delete "Rising" and insert -- fusing --.

In Column 10, line 31 (Claim 17), delete "claim 15" and insert -- claim 14 --.

Signed and Sealed this

Twenty-third Day of November, 2010

David J. Kappos

David J. Kappos
*Director of the United States Patent and Trademark Office*